United States Patent [19]

Vauquois

[11] 3,949,755

[45] Apr. 13, 1976

[54] SURGICAL LIGATURE

[75] Inventor: Paul Vauquois, Champagne-au-Mont-d'Or, France

[73] Assignee: Rhone-Poulenc-Textile, Paris, France

[22] Filed: Apr. 9, 1974

[21] Appl. No.: 459,415

[30] Foreign Application Priority Data

Apr. 9, 1973 France ..... 73.12620

[52] U.S. Cl. ..... 128/335.5

[51] Int. Cl.[2] ..... A61L 17/00

[58] Field of Search ..... 128/335.5, 326; 206/63.3

[56] References Cited

UNITED STATES PATENTS

| | | | |
|---|---|---|---|
| 1,382,715 | 6/1921 | Davis | 206/63.3 |
| 1,564,983 | 12/1925 | Soresi | 128/335.5 |
| 2,909,177 | 10/1959 | Dowd et al. | 128/335.5 |
| 3,047,352 | 7/1962 | Santoro et al. | 128/335.5 |
| 3,762,418 | 10/1973 | Wasson | 128/335.5 |
| 3,840,015 | 10/1974 | Gain | 128/335.5 |

*Primary Examiner*—Dalton L. Truluck

*Attorney, Agent, or Firm*—Cushman, Darby & Cushman

[57] ABSTRACT

A surgical ligature in which a sterile thread has a surface on which is a succession of areas, for example, lines or dots, of contrasting shades, whereby at least one of the shades appears dark through a film of blood and at least one of the shades appears light through a film of blood. Such a ligature can readily be seen by the surgeon through the blood and against the background of the organ being stitched.

10 Claims, 2 Drawing Figures

FIG. 1
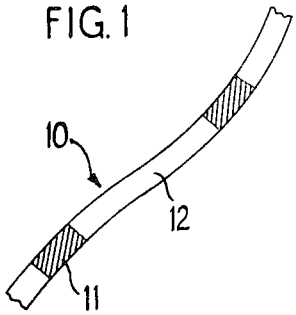
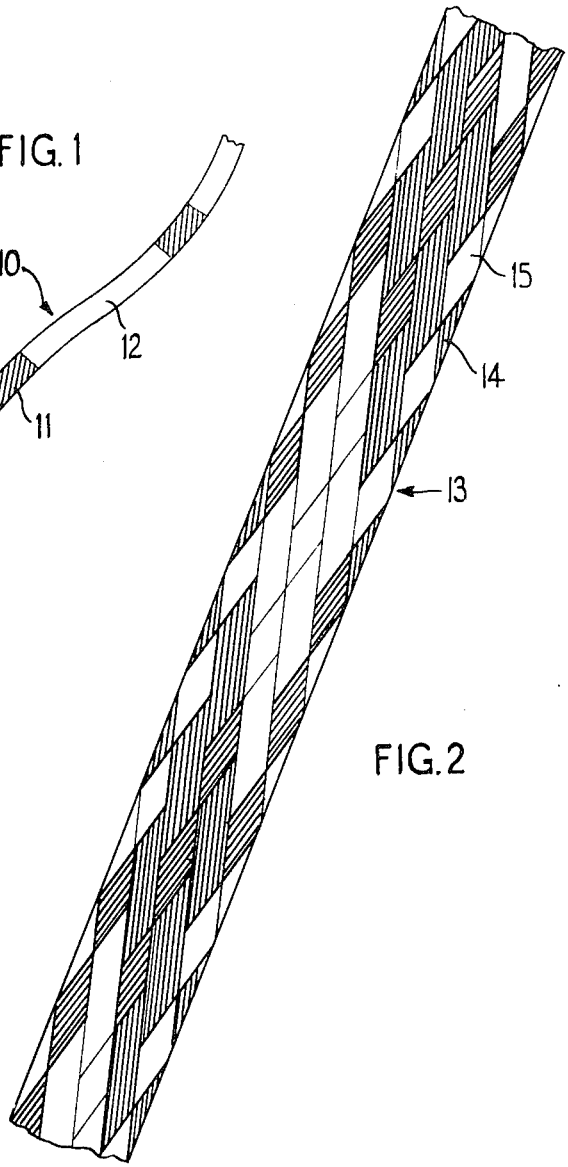
FIG. 2

SURGICAL LIGATURE

The subject of the present invention is a surgical ligature.

The use of materials for ligatures in surgery poses special problems which are not encountered for other applications. In addition to the fact that these ligatures must be made of materials which can be sterilised and which are not harmful to the organism, it must be possible especially to handle them and to place them in position without loss of time in cavities which are sometimes deep and soaked with blood.

These ligatures are usually white or light in colour.

In order to make it easier to place them in position it has been proposed to give these ligatures dark shades or shades which appear dark through the blood which will usually cover them, such as black, blue and especially green.

However, experience shows that special attention on the part of the surgeon is required for placing the ligatures in position, because it so happens that natural organs, for example small vessels, have the same appearance.

The subject of the invention is a surgical ligature which can be placed in position easily even when it is soaked with blood.

According to the present invention, there is provided a surgical ligature comprising a sterile thread having a surface on which is a succession of areas of contrasting shades, whereby at least one of the shades appears dark through a film of blood and at least one of the shades appears light through a film of blood.

The invention also concerns a method of suturing comprising stitching with such a thread. The dark colour can be seen readily through the film of blood, while the light colour shows up easily against the background of the organ being stitched.

The first shade can be naturally dark, for example black or green. It can also be chosen from amongst the colours which absorb red, for example green and blue: under these conditions, the shade can be lighter.

Simple tests make it possible to be certain that the contrast is satisfactory.

A braid consisting of filaments of substantially uniform colouration divided into at least two groups of contrasting colours is preferably employed as the surgical ligature.

The individual filaments can be dyed in a full bath. In the case of filaments extruded from synthetic materials (for example, polyester or polyamide) or regenerated materials (for example, collagen), it is possible to disperse pigments or dyestuffs in the starting collodion.

In order to produce the braids according to the invention, it is possible to use any natural, regenerated, artificial or synthetic material which can be spun and braided and which can have a surgical application.

Resorbable materials can also be used if they fulfil the above characteristics.

Naturally, a diversity (although limited) of possible shades can be used simultaneously for purposes of marking positions by means of a code, for example in order to differentiate between resorbable and non-resorbable sutures.

In order to produce braids according to the invention, it is possible to use braiding machines of conventional type comprising three to 104 spindles and preferably four to 52 spindles, equipped with yarns of at least two contrasting shades.

In order that the invention may more readily be understood, the following description is given, merely by way of example, reference being made to the accompanying drawing in which the two figures are each perspective views of two different embodiments of ligature according to the invention.

In the construction of FIG. 1, the ligature comprises a sterile monofilament thread 10 having a series of dots 11 of a contrasting colour to the remainder 12 of the thread.

The embodiment of FIG. 2 is formed as a braid 13, having some filaments 14 of one shade and some filaments 15 of a contrasting shade.

The following examples of a ligature according to the invention are given by way of illustration.

EXAMPLE 1

Using a braiding machine of conventional type comprising 12 spindles, 11 spindles of polyester yarn (polyglycol terephthalate), coloured white and of gauge 50 dtex, and one spindle of polyester yarn of 50 dtex, coloured black throughout its bulk by means of a black pigment are mounted.

A braid of nominal diameter 20/100 mm with a mottled appearance is obtained.

EXAMPLE 2

Using a braiding machine comprising 16 spindles, eight spindles of polyester yarn of 100 dtex, pigmented black, and eight spindles of polyester yarn of 100 dtex, dyed green (dyestuff: D.C. Green No. 6 of KOHN-STAMM — US) are mounted.

A braid with a nominal diameter of 40/100 mm and a mottled appearance is obtained.

I claim:

1. A surgical ligature comprising a sterile thread having a surface on which is a succession of closely spaced areas of contrasting shades, whereby at least one of the shades appears dark through a film of blood and at least one of the shades appears light through a film of blood.

2. A surgical ligature as claimed in claim 1, wherein said succession of areas comprises a succession of dots.

3. A surgical ligature as claimed in claim 1, wherein said succession of areas comprises a succession of lines.

4. A surgical ligature as claimed in claim 1, wherein the sterile thread comprises a braid formed from filaments of at least two contrasting shades.

5. A surgical ligature as claimed in claim 4, wherein the braid consists of between 3 and 104 filaments.

6. A method of suturing comprising stitching with a sterile thread having a surface of which is a succession of closely spaced areas of contrasting shades, whereby at least one of the shades appears dark through a film of blood and at least one of the shades appears light through a film of blood.

7. A method of suturing as claimed in claim 6, wherein said succession of areas comprises a succession of dots.

8. A method of suturing as claimed in claim 6, wherein said succession of areas comprises a succession of lines.

9. A method of suturing as claimed in claim 6, wherein the sterile thread comprises a braid formed from filaments of at least two contrasting shades.

10. A method of suturing as claimed in claim 9, wherein the braid consists of between three and 104 filaments.

* * * * *

UNITED STATES PATENT OFFICE

CERTIFICATE OF CORRECTION

Patent No. 3,949,755 Dated April 13, 1976

Inventor(s) Paul Vauquois

It is certified that error appears in the above-identified patent and that said Letters Patent are hereby corrected as shown below:

In the heading:

Change the name of the assignee from "Rhone-Poulenc Textile" to --Rhone-Poulenc S. A.--.

Signed and Sealed this

Eleventh Day of January 1977

[SEAL]

*Attest:*

RUTH C. MASON
*Attesting Officer*

C. MARSHALL DANN
*Commissioner of Patents and Trademarks*